United States Patent [19]

Morris, Jr.

[11] 4,440,604

[45] Apr. 3, 1984

[54] METHOD FOR THE MANUFACTURE OF LAPPING DISC FOR FORMING KEELS ON VIDEODISC STYLI

[75] Inventor: Charles H. F. Morris, Jr., Allentown, N.J.

[73] Assignee: RCA Corporation, New York, N.Y.

[21] Appl. No.: 436,378

[22] Filed: Oct. 25, 1982

[51] Int. Cl.[3] ..... C25D 1/10
[52] U.S. Cl. ..... 204/5
[58] Field of Search ..... 204/5

[56] References Cited

U.S. PATENT DOCUMENTS 3,947,348 3/1976 Schabernack ..... 204/9

FOREIGN PATENT DOCUMENTS 2721637 11/1978 Fed. Rep. of Germany ..... 204/5

*Primary Examiner*—T. Tufariello
*Attorney, Agent, or Firm*—Birgit E. Morris; Edward J. Sites

[57] ABSTRACT

In the matrixing process used in the manufacture of lapping discs employed in the production of videodisc styli, it has been found that the separation of the electroformed parts from the parts on which they are formed can be performed effectively and simply by heating the assembly of the electroformed part and the part on which it is formed to an elevated temperature which causes the parts to separate from each other without distortion of the lapping grooves and without damage to either of the parts.

9 Claims, 11 Drawing Figures

METHOD FOR THE MANUFACTURE OF LAPPING DISC FOR FORMING KEELS ON VIDEODISC STYLI

This invention relates to a method for manufacturing lapping discs for forming keels on videodisc styli, and more particularly, is concerned with an improvement in the matrixing method used to form stampers used for the molding of the lapping discs.

BACKGROUND OF THE INVENTION

Videodiscs are molded records which have a signal track formed in the surface thereof which contains signal information which corresponds to a television broadcast signal.

U.S. Pat. No. 3,842,194, issued on Oct. 15, 1972 to J. K. Clemens, discloses a videodisc playback system of the capacitance electronic type. In one configuration of the Clemen's type videodisc, signal information which corresponds to video and audio programming is encoded in the form of a surface relief pattern in a relatively narrow spiral information groove molded into the surface of the videodisc made of a conductive plastic. During playback, the pickup stylus tracks in the spiral information groove as the videodisc is rotated by the turntable of the videodisc player. Capacitance variations between the electrode on the stylus and the conductive videodisc surface are detected and used to reconstruct the information recorded in the videodisc.

U.S. Pat. No. 4,162,510, issued on July 24, 1979 to E. O. Keizer, discloses a keel tip stylus for use with a capacitive electronic videodisc player of the type disclosed in the Clemens' patent. The stylus disclosed in the Keizer patent has a support of a hard wearing dielectric material such as diamond. The Keizer stylus has the conductive electrode formed on one surface thereof for detecting the variations in capacitance. The Keizer stylus is generally of a elongated rectangular configuration. The terminal end of the stylus which tracks in the information track of the videodisc, however, is shaped to a point so as to have a prow like front to guide the stylus in the information track. The terminal end is further shaped so as to have a keel-like section of reduced size to facilitate tracking of the stylus in the information groove. The keel is of an extremely small size, being about two microns in height and width and about 3–5 microns in length.

The formation of the keels on styli so as to have the required dimensions is one of the more difficult tasks involved in the manufacture of styli. In U.S. Pat. No. 4,104,832, issued on Aug. 8, 1972 to E. O. Keizer, there is disclosed a method in which a lapping disc having an abrasive on the surface thereof is used to lap the keel onto previously pointed styli. The lapping disc which is disclosed is similar to a molded videodisc except it has a groove formed in its surface which mates to the shape of the keel to be formed on the styli. An abrasive such as $SiO_x$ is applied to the surface of the lapping disc and previously pointed styli are guided through the groove until a sufficient material is lapped from the end of the styli to form keels of the desired configurations.

The method disclosed in the Keizer U.S. Pat. No. 4,104,832 has proven to be a highly successful method for forming a keel on a styli. Problems, however, are still encountered if the grooves of the lapping disc do not have the correct configuration along the entire length of the groove in the lapping disc. It is important that the width of the groove and its shape be uniform along its entire length. If the groove narrows, for example, it can cause excessive abrasion of the stylus being lapped or can inpart a dynamic shock to a stylus being processed so as to break the keel off the stylus. Other problems are likewise encountered as a result of defects in the lapping disc. Many of the defects in the lapping can be traced back to the matrixing process used in the manufacture of the disc.

The method used to manufacture lapping discs is in many respects similar to the method used to manufacture videodiscs; however, considerably more problems are encountered in the matrixing process when manufacturing lapping discs as compared to videodiscs. As disclosed in copending U.S. application 238,805 filed Feb. 27, 1981 by G. Kaganowicz, a groove having the desired shape of the keel is electromechanically recorded into a metal substrate. In the next step, the surface of the recorded metal substrate is passivated and thereafter a metal, typically nickel, is electroformed on the surface of the recorded substrate to form a master. After the master is electroformed to the desired thickness, typically 9 mils, it must be separated from the surface of the recorded substrate. It is at this point in the matrixing process used for lapping discs that considerable problems are encountered as compared to the matrixing processes used for videodiscs. With videodiscs once the outer edges and the center portions of the recorded substrate and the master are separated, it is generally relatively simple to separate the parts from each other. In the manufacture of lapping discs, however, even though the outer edges and center portions are well separated, it is often still extremely difficult, if not impossible, to separate the lapping disc master from the recorded substrate. Considerable mechanical force is often required, such as using metal clamps or the like to pull the master from the surface of the recording substrate. Very often the force required to separate the parts irrepairably damages either the recording substrate, the master or both. The reason for the greater difficulty encountered in separating the master from the recording substrate when making lapping disc is not known for certain.

The mechanical force involved in the techniques heretofore employed for the separation of the electroformed master from the recorded substrate is believed to be one of the major causes of distortion of the grooves molded into the lapping disc. There are protrusions on the lapping disc master which correspond to the grooves in the molded lapping disc that can readily be bent or crushed during separation so as to change the width of the lapping groove ultimately molded into the lapping disc.

After the lapping master is separated from the recorded substrate, it is in turn passivated and replicated by electroforming a metal again, such as nickel, on its surface to form what is referred to as a mold. Difficulties are also often encountered in separating the molds from the masters, but in general it is not as difficult as separating the lapping disc masters from the recorded substrate.

The matrixing process is completed by electroforming a metal such as nickel on the molds to form parts referred to as stampers. Difficulty is also encountered when separating stampers from the molds but again, not as much difficulty as when attempting to separate the master from the recorded substrate.

The stamper is the metal part which is actually used to mold the lapping disc from a plastic material such as a vinyl resin. In order to have a satisfactory stamper for use in the molding of the plastic lapping disc, it is important that the width and shape of the lapping grooves be precisely maintained in the desired configuration throughout the entire matrixing process.

What would be highly advantageous would be an improvement in the matrixing method used for manufacture of the lapping disc which will facilitate the separation of the electroformed parts from the parts on which they are electroformed and in particular an improved method to separate electroformed masters from metal recording substrates.

SUMMARY OF THE INVENTION

It has been found that in the matrixing process used in the manufacture of lapping discs employed in the production of videodisc styli, that the separation of the electroformed parts from the parts on which they are formed can be effectively and simply performed by heating the assembly of the electroformed part and the part on which it is formed to a elevated temperature which causes the parts to separate from each other without distortion of the lapping grooves and with out damage to either of the parts.

DETAILED DESCRIPTION OF THE INVENTION

While the reason for the increased difficulty in separating parts in the matrixing process used for the manufacture of lapping discs as compared to the matrixing process used for making videodiscs is not known with certainty, it is believed to be due in part to the difference in geometry of the groove of a lapping disc and that of a videodisc signal track. A videodisc signal track is relatively shallow and wide with sloping walls, typically about 2.7 micrometers wide, but only about 0.4 micrometer in depth with the walls forming about a 135° vee. A videodisc information track accordingly has an aspect ratio of about 7. The groove of a lapping disc is, however, about 2 micrometers wide and at least about 2 micrometers in depth, with the walls of the groove being almost perpendicular to the surface plane of the disc. The groove of the lapping disc accordingly has an aspect ratio of about 1 or less and the walls are almost perpendicular. It is believed that it is the overall difference in the geometry of the shape of the groove in the lapping disc as compared to a videodisc information track which causes the increased difficulty in separating the parts in the matrixing process employed in the matrixing of lapping discs. The problems encountered in separating the lapping master from the surface of the recorded substrate may also further be complicated due to micromachining defects in the recorded substrates which may cause slight roughness in the walls of the groove which further causes resistance to separation of the master from the recording substrate after electroforming.

Figure 1:
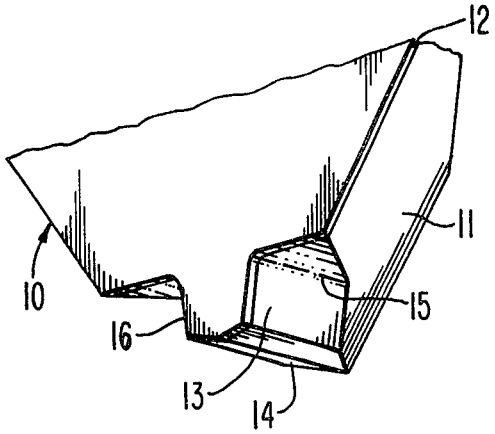
FIG. 1 is an isometric projection of the terminal end portion of a keeled capacitive electronic pickup videodisc stylus.
Figure 2:
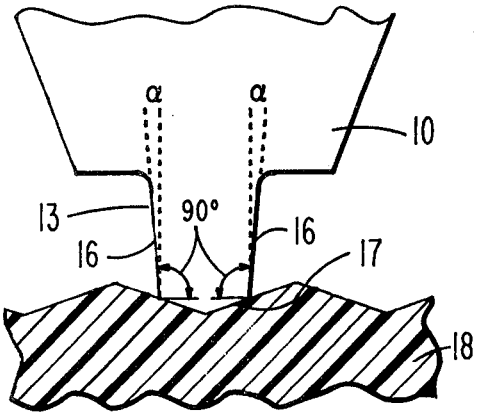
FIG. 2 is an illustration of the tip portion of a videodisc stylus shown in engagement with the information track of a videodisc.

In FIG. 1 there is shown the terminal portion of a videodisc stylus 10. The videodisc stylus 10 has a main support body 11 which is generally made of a hard resistance dielectric material such as diamond. On the surface of the stylus, there is a metal electrode 12 which forms one of the electrodes required for capacitive pickup as described above. At the terminal end portion of the video disc stylus there is formed a keel 13 which in the preferred form has a v shaped bottom 14 with a fillet 15 at the juncture of the keel 13 with the main portion of the stylus 10. The keel as formed has substantially perpendicular side walls 16 which have at most about a 4 to 5 degree relief as indicated by the angle (a) in FIG. 2. The amount of the relief angle (a) is limited in that as a stylus wears it must still retain a sufficiently narrow width that it will guide properly in the signal track 17 of the videodisc 18.

Figure 3:
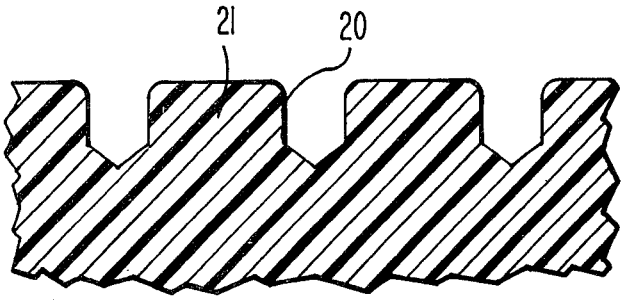
FIG. 3 is a cross section configuration of several grooves of a lapping disc used for keel lapping of videodisc styli.
Figure 4:
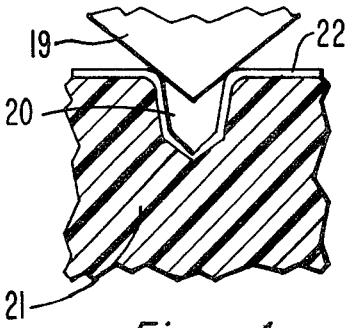
FIG. 4 is an illustration of a tipped videodisc stylus blank in contact with the groove of a lapping disc at the start of the keel lapping process.
Figure 5:
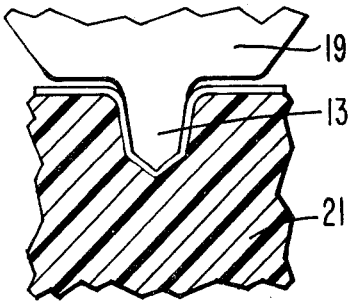
FIG. 5 is an illustration of the videodisc stylus of FIG. 4 shown engaged with the lapping disc at the completion of the keel lapping process.

The keel 13 is formed on the stylus 10 by lapping a tipped but unkeeled stylus blank 19 in the groove 20 of a lapping disc 21. The lapping disc 21 as shown in FIG. 3 is a plastic disc which has formed in its surface a spiral groove 20 which mates with the desired shape of the keel 13 to be formed on the terminal end of the stylus blank 19. To form the keel 13, the pointed terminal end of the stylus blank 19 is guided in the groove 20 of the lapping disc 21. Preferably an abrasive layer 22 of silicon dioxide is formed on the surface of the lapping disc 21. The lapping disc 21 is then rotated in a manner similar to playing a record which causes lapping of the stylus blank 19 until finally, as shown in FIG. 5, a keel 13 is formed on the stylus blank 19.

Figure 6:
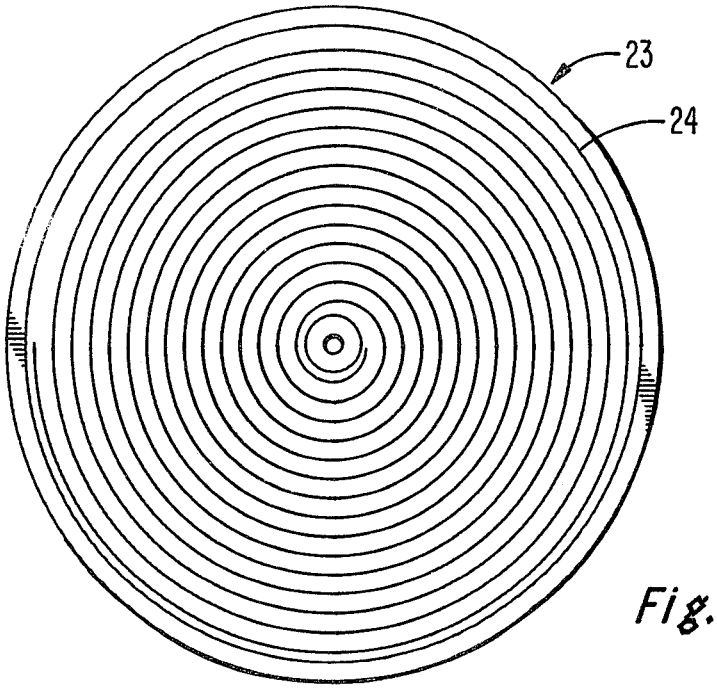
FIG. 6 is a top plane view of a recording substrate having a spiral lapping groove cut into the surface thereof.
Figure 7:
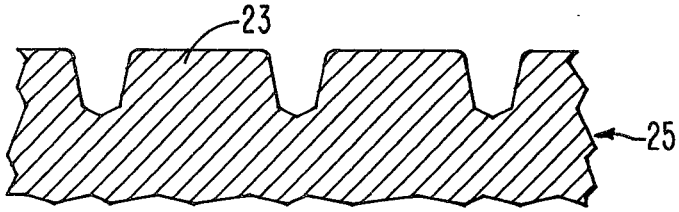
FIG. 7 is a partial cross sectional illustration of the recorded substrate of FIG. 6.

As shown in FIG. 6, the metallic recorded substrate 23 has cut into its surface a spiral groove 24. For purpose of illustration, the spiral groove 24 is widely separated. In actual practice, the grooves would generally be cut in a much tighter spiral having about 4000 grooves per inch or higher. It should be noted that the cross section 25 of the recorded metal substrate 23 shown in FIG. 7 corresponds to the cross section of the plastic lapping disc 21 shown in FIG. 3.

Figure 8:
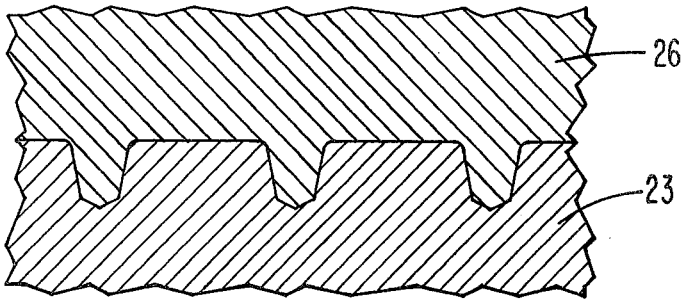
FIG. 8 is a cross-sectional illustration of a section of a metal master formed on a portion of the recording substrate.
Figure 9:
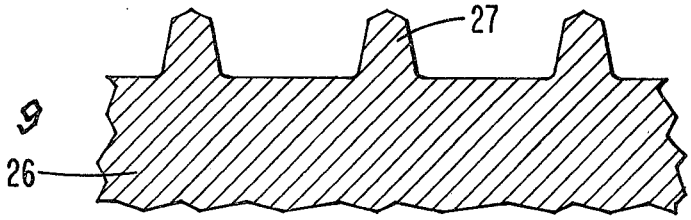
FIG. 9 is a cross section illustration of a portion of the surface of a master.
Figure 10:
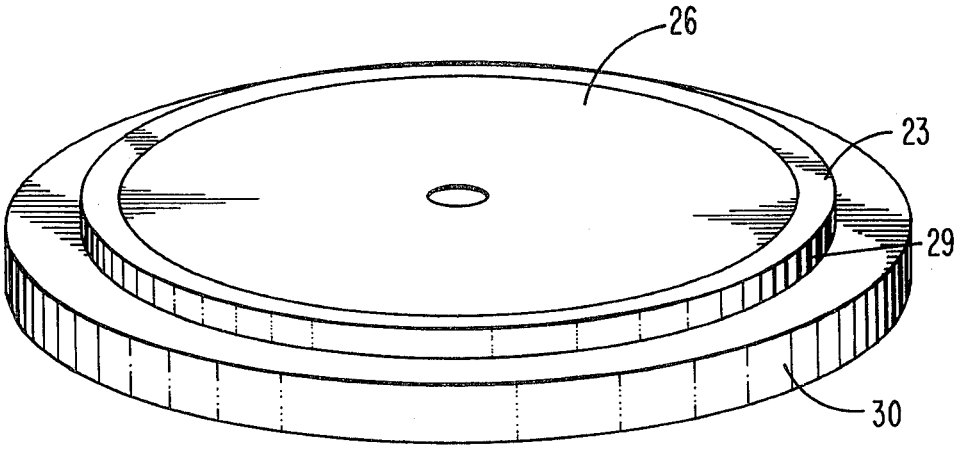
FIG. 10 is an illustration of an assembly of an electroformed part and the part on which it was electroformed placed on a heated support in accordance with the preferred embodiment of the method of the present invention.

A nickel master 26 is electroformed on the recorded substrate 25 as shown in partial cross section in FIG. 8. After the nickel master 26 is separated from the recording substrate 23, it should have projections 27 which mate with the groove 20 of the lapping disc 21. The nickel master 26 in surface configuration should be the same as that desired in the stamper. It is believed that because of the relatively small size, about 2 millimicons by 2 millimicrons, of these projections 27 on the master 26, they are relatively easy to distort. Accordingly, it is important that the master 26 be separated from the recorded substrate 23 without applying excessive force to the projections 27.

Figure 11:
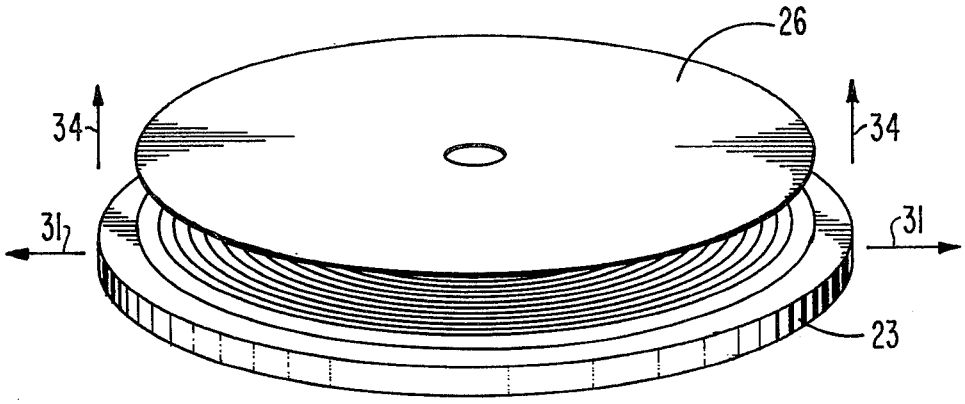
FIG. 11 is an illustration of the separation of the electroformed part from the part on which it is formed.

In accordance with the preferred embodiment of this invention, after the outer and inner edges of the parts have been split apart, the separation of the master 26 from the substrate 23 is effectively and simply performed by heating the assembly 29 of recorded substrate 23 and master 26 on a heated support 30. The heated support 30 can be, for example, a conventional hot plate or the like. The temperature of the assembly 29 must be sufficient to cause separation of the master 26 from the substrate 23. The temperature to which the assembly 29 is raised can be for example somewhat above normal room temperature and preferably typically is about 140° F. to 200° F. The assembly 29 should be heated as rapidly as possible and preferably from only one surface of the assembly 29 preferred the substrate side in order to obtain optimum results. As the parts are heated, the nickel master 26 formed on the recorded substrate 23 will snap release from the surface of the recorded substrate 23. This reaction is believed to be due to a combination of differences in the rate of expansion of the recorded substrate 23 relative to the nickel master 26 which in combination with slight leads on the walls of the groove 20 formed in the substrate 23 causes the separation of the parts. As shown in FIG. 11, the recorded substrate 23 expands in an outward direction 31 which, in combination with the slight lead, causes an effective vectored upward force 34 which results in separation of the nickel master 26 from the surface of the recording substrate 23.

Because the heat is applied substantially uniformally across the entire width of the assembly 29 of the master 26 and the recorded substrate 23, the forces are applied uniformly on walls of the grooves. There is accordingly no localized forces as in the mechanical separation method heretofore employed in the prior art.

The technique which has been described above for the separation of the nickel masters 26 from the recorded substrate 23 has been found to be highly effective and simple to use in practice. The nickel master 26 separates without any distortion and without damage to the recorded substrate.

In describing a preferred embodiment of the invention, attention was directed to the use of a heated support 30 to cause the separation of the assembly 29 of the parts in the matrixing process. It should be noted, however, that other methods of supplying heat to cause a differential expansion of the parts so as to urge the separation of the parts can likewise be used in accordance with the present invention. For example, the assembly 29 can be placed in a heated environment such as an oven and raised to an elevated temperature in order to cause the separation of the parts. Furthermore, heat can be applied for example by using gas burners or the like. A further technique which has also been found to be suitable with regard to separation of the nickel master 26 from the recorded substrate 23 is to resistance heat the recording substrate 23 by attaching electrical contacts to it. These and other similar variations of the present invention are included within the scope of the invention.

It should also be noted further that the technique of using heat to separate the assembly of the recorded substrates and masters can also be used for the separation of other parts in the matrixing process. The method can be used for the separation of molds from the masters on which they are formed and also stampers from molds on which they are formed. The method of this invention when used to separate assemblies of other types of matrix parts as noted above, improves the ease of separation and the quality of the resulting part.

The keel lapping disc molded on stampers manufactured in accordance with the present invention have improved lapping properties with regard to the uniformity of the width and shape of the groove in the lapping disc and the quality of the lapping of the keel on the styli is substantially improved.

What is claimed is:

1. In the matrixing method employed in the manufacture of a lapping disc for forming a keel of a predetermined cross sectional configuration on a terminal end of a videodisc stylus wherein a flat surface of a metal substrate is recorded with a spiral groove having an aspect ratio of about one or less, almost perpendicular walls and a configuration substantially mating the predetermined cross sectional configuration of the keel and a metal master is thereafter electroformed on the surface of the substrate to provide an assembly of a predetermined diameter of the master formed on the substrate, the improvement which comprises: causing the separation of the master from the substrate by substantially uniformly heating the assembly to a temperature sufficient to cause separation of the master from the substrate.

2. The method according to claim 1 wherein heat is applied to only one surface of the assembly.

3. The method according to claim 1 wherein heat is applied to the substrate portion of the assembly.

4. The method according to claim 1 wherein the assembly is heated at a temperature of about 140° F. to about 200° F.

5. The method according to claim 1 wherein the heat is applied by placing the assembly on a heated support surface.

6. The method according to claim 1 wherein the heat is applied to the assembly by placing the assembly in a heated environment.

7. The method according to claim 1 wherein the heat is supplied by electrically resistance heating of the substrate.

8. The method according to claim 1 which further includes electroforming a mold on the master after it is separated from the substrate to provide an assembly of a master and mold and thereafter heating the assembly of the master and mold to a temperature sufficient to cause separation of the mold from the master.

9. The method according to claim 8 which further includes electroforming a stamper on the mold after the mold is separated from the master to provide an assembly of the mold and stamper and thereafter heating the assembly of the mold and stamper to a sufficient temperature to cause separation of the stamper from the mold.

* * * * *